United States Patent [19]

Hastings

[11] 4,248,468

[45] Feb. 3, 1981

[54] LITTER AND REFUSE RETRIEVAL DEVICE

[76] Inventor: Edward L. Hastings, 4025 Dean Dr., Oak Lawn, Ill. 60453

[21] Appl. No.: 83,375

[22] Filed: Oct. 10, 1979

[51] Int. Cl.[3] ..... A01K 29/00

[52] U.S. Cl. ..... 294/1 BA; 294/115

[58] Field of Search ..... 294/1 BA, 11, 19 R, 294/22, 50.6, 50.8, 50.9, 55, 100, 106, 115

[56] References Cited

U.S. PATENT DOCUMENTS

| | | | |
|---|---|---|---|
| 1,231,116 | 6/1917 | Bender | 294/115 |
| 2,145,807 | 1/1939 | Sharp | 294/11 X |
| 2,230,498 | 2/1941 | Loos et al. | 294/50.8 |
| 2,852,302 | 9/1958 | Steffen | 294/115 X |
| 3,265,429 | 8/1966 | Shatt | 294/19 R |
| 3,617,084 | 11/1971 | Mares | 294/106 X |
| 3,841,686 | 10/1974 | Gallo et al. | 294/1 BA |

FOREIGN PATENT DOCUMENTS

| | | | |
|---|---|---|---|
| 266858 | 10/1965 | Australia | 294/50.8 |
| 539531 | 9/1941 | United Kingdom | 294/115 |

*Primary Examiner*—Johnny D. Cherry
*Attorney, Agent, or Firm*—Gerald S. Geren

[57] ABSTRACT

There is disclosed herein a refuse retrieval device having an elongated frame with a handle at one end, scoop-supporting arms at the other end and an elongated central section therebetween. Clamshell-like scoops are mounted to the supporting arms. A control rod is carried by the frame and is connected to the scoops for opening and closing the scoops. There is also provided biasing means associated with the control rod and the frame so as to normally urge and maintain the scoops in a closed position. The control rod is mounted for axial movement between the scoop closed and scoop open position. The control rod also includes a handle which is positioned within a frame handle and which can be retracted by the use of one hand so as to open the scoops.

1 Claim, 4 Drawing Figures

FIG. 1
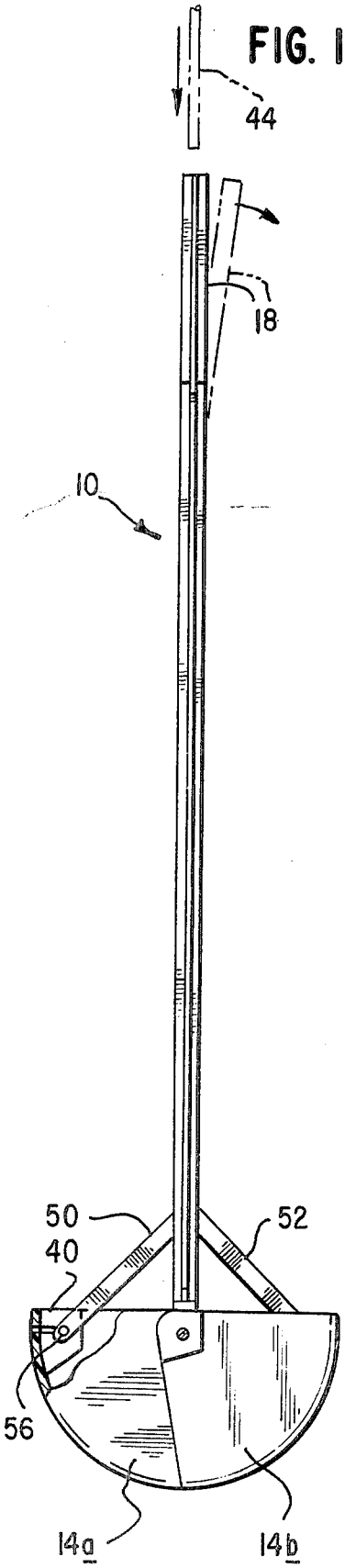
FIG. 2
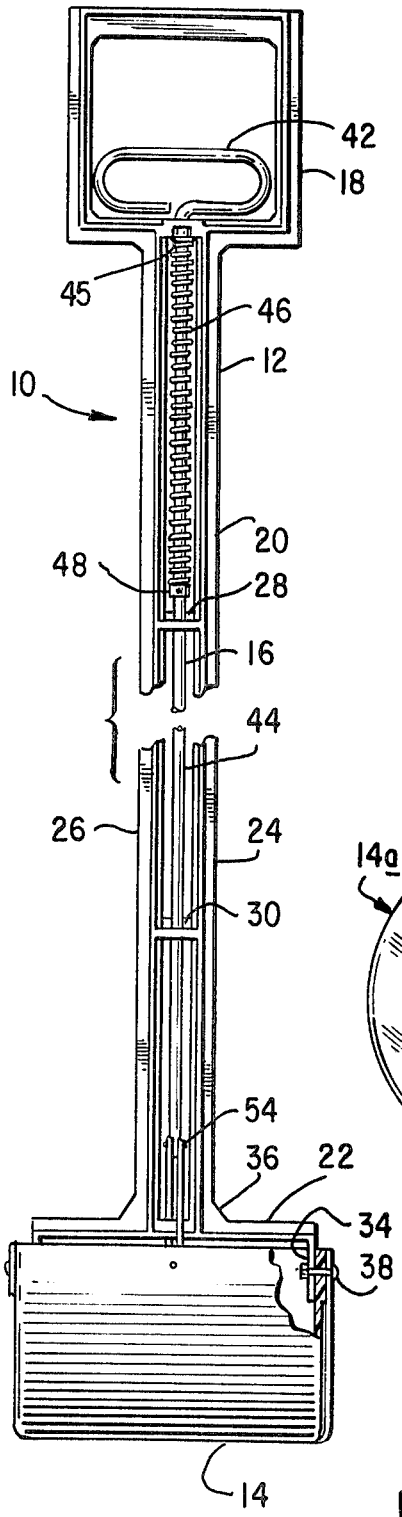
FIG. 3
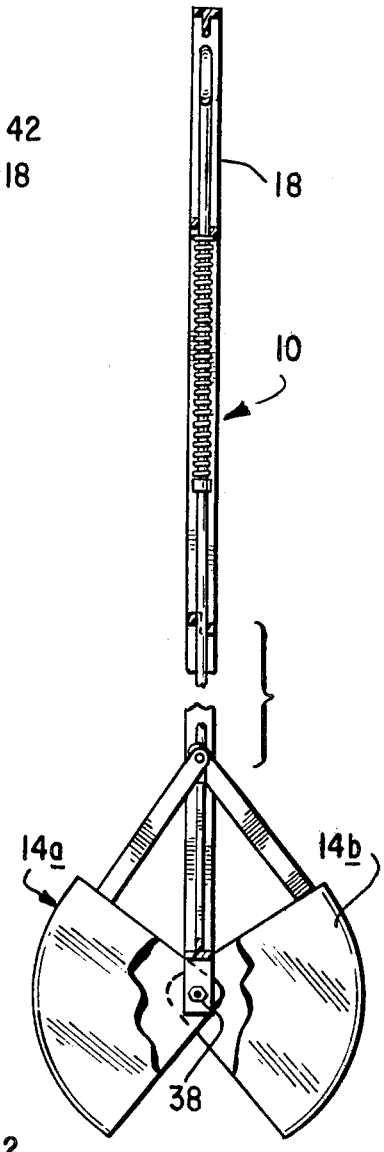
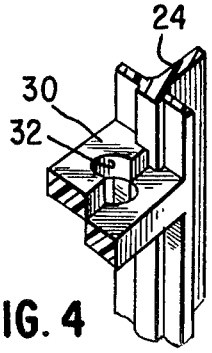
FIG. 4

LITTER AND REFUSE RETRIEVAL DEVICE

BACKGROUND OF THE INVENTION

This invention relates to hand-activated waste and refuse retrieval devices, especially the type which is useful for retrieving pet litter and refuse.

In large urban areas pet owners walk their pets, usually dogs, and local ordinances have been enacted which require that such owners clean up after their pets. Thus there is a need for devices for quickly and sanitarily cleaning up after a pet.

In many urban areas it is also required that the animal be kept on a leash so that the owner will always have control of the animal.

U.S. Pat. No. 3,617,084 discloses a hand-operated shovel for picking up refuse, which is generally directed at the same problem. However, the device disclosed therein requires the use of two hands in a rotary motion in order to operate the device. This can be inconvenient to use and could present some problems in connection with maintaining control of the pet on the leash. Furthermore, the device appears to be relatively complex in construction and could be expensive to mass produce.

It is therefore an object of this invention to provide a clean-up device which does not require two-handed operation and a device which is less expensive to construct.

U.S. Pat. No. 2,554,911 discloses a garden tool for grasping or picking up objects at a distance. The device is operated with only a single hand, but its jaws are biased toward a normally open position requiring the operator to act against the biasing force in order to maintain a grasp on the object. Furthermore, the device appears to be fabricated from a number of parts and could also be expensive to manufacture.

It is an object of this invention to provide a refuse retrieval device which the user activates only in order to retrieve the refuse and which can be released after retrieval and still retain a grasp on the litter or other object.

It is also an object to provide an apparatus which is inexpensive to manufacture.

These and other objects will become apparent from the following description and appended claims.

SUMMARY OF THE INVENTION

There is disclosed herein a litter retrieval apparatus which includes scoops that are maintained in a normally closed position and which is operable with a single hand to open the scoops to permit retrieval of litter. Once the refuse is retrieved, it can be held within the scoops without the user being required to exert any effort in order to keep the scoops closed. This device is believed to overcome the problems of prior art devices.

The device includes an elongated unitary plastic frame having a handle section at one end, a pair of scoop-supporting arms at the other end, and an elongated central section having a control rod receiving passageway. A control rod extends through the passageway from the handle to the scoops. Linkages connect the lower end of the control rod to the scoops and spring-biasing means are provided for biasing the control rod toward the scoops so as to normally maintain the scoops in a closed position. The operator, using only one hand, can pull the control rod away from the scoops so as to open the scoops and permit the retrieval of the refuse.

The frame handle can be flexed so as to permit insertion of the rod into the central passageway during assembly.

BRIEF DESCRIPTION OF THE DRAWINGS

FIG. 1 is a side view of the retrieval device showing in dashed lines the frame handle being flexed so that the control rod may be inserted into the frame;

FIG. 2 is a front view of the retrieval device having a portion of the central section thereof broken away;

FIG. 3 is a side view of the retrieval device showing the scoops in an open position and with a portion of the central portion of the device broken away for convenience; and FIG. 4 is a greatly enlarged fragmentary section showing a portion of the frame.

DESCRIPTION OF THE PREFERRED EMBODIMENT

Referring now to the drawings, there is shown a refuse retrieval device 10 generally. The device includes: an elongated, molded-plastic, unitary frame 12; a pair of clamshell-like scoops 14 generally; and a control rod assembly 16 for operating the scoops.

The frame 12 has a box-shaped handle 18 at the upper end thereof, an elongated center section 20, and a pair of scoop-supporting arms 22 at the lower end.

The center section 20 is formed from two spaced, parallel and T-shaped beams 24 and 26. The beams are connected to each other by transverse rigidifying braces, such as 28 and 30, which are molded so as to define a control rod receiving guide aperture therein. As seen in FIG. 4, the brace 30 is molded in an offset manner so as to define a guide aperture, such as 32.

Each of the arms 22 extend transversely from the center section 20 and terminate in a downwardly-extending tab, such as 34, to which the clamshell-type scoops are connected. A small web, such as 36, connects beam 24 with the arm 22 so as to provide rigidity. The entire frame 12 generally lies in a plane and the frame is molded of a plastic material, such that the handle can flex about its connection to the central section 20. This flexing of the handle is best seen in FIG. 1.

The clamshell-like scoops 14 include two half sections **14*a* and 14*b*, which are connected to each of the tabs by a pin-type fastener 38. Each of the half sections also includes centrally-positioned, inwardly-extending, linkage-connecting webs, such as 40**.

The control rod 16 is a metal member having a preformed handle 42 for positioning within the frame handle 18 and a slender elongated body 44. The body 44 extends through guide apertures, such as 32, in the passageway defined by the beams 24 and 26.

A positioning washer 45, a helical biasing spring 46, and a spring-retaining collar 48 are positioned at the upper end of the frame adjacent the handle, and the control rod extends through and cooperates with these parts.

A pair of link arms 50 and 52 are provided for connecting the lower end of the control rod to the scoops. The upper ends of the arms are connected to the rod by a pin 54 and the lower ends of each of the link arms 50 and 52 are connected to the clamshell webs, such as 40, by a pin, such as 56.

Fabrication

The device is fabricated by molding the frame 12 from a suitable flexible and resilient plastic material. Each of the scoop halves is also molded and fastened to the frame tabs 34 by a pin or nut-and-bolt connection 38. The control rod 16 is formed from a metallic rod and a grasping handle 42 is formed.

In order to assemble the control rod to the frame, washer 45, spring 46 and collar 48 are positioned between the handle and the first brace, such as 28. Thereafter, the handle 18 is flexed out of the plane of the frame, as shown in FIG. 1, and the lower end of the control rod is inserted through the guide aperture where the handle base joins the central section through the washer, spring and collar and then through the remaining guide apertures. Thereafter the link arms 50 and 52 are connected to the rod and scoops at the respective webs, such as 40, and are pinned to the lower end of the control rod.

The retaining collar 48 is then secured to the rod at a position which provides the appropriate biasing force which maintains the scoop in the closed position and the control rod handle spaced from the upper edge of the frame handle.

Operation

The retrieval device 10 is carried by the user holding the upper edge of the handle 18 and carrying the same, or by the user grasping the control rod handle 42 and the upper part of the handle 18. If a user does not exert any force on handle 42, the biasing spring 46 in cooperation with the collar 48 and washer 45 urges the rod in an axial direction toward the scoops 14. This biasing force urges the links 50 and 52 toward the scoops and cooperates with the webs 40 so as to maintain the scoops in a closed position.

When the user decides to retrieve refuse or litter, he grasps the control rod handle 42 and draws it upwardly toward the upper edge of the handle 18 and against the force of the biasing spring 46. This upward movement draws the links 50 and 52 upwardly, which, in turn, causes each of the sections of the clamshell scoops to pivot about connections, such as 38, and thereby open. The open scoops are then placed over the refuse and the control rod is released, thereby permitting the biasing spring to urge the rod downwardly, which in turn cooperates with the links to close the scoops. With the refuse within the closed scoops, the user releases his grasp of handle 42 and can carry whatever refuse has been retrieved within the scoops without exerting any force to overcome the biasing spring.

Thus there has been provided a device which can be easily manufactured and used with one hand, thereby keeping the other hand free.

It will be appreciated that numerous changes and modifications can be made to the embodiment shown herein without departing from the spirit and scope of this invention.

What is claimed and desired to be secured by Letters Patent of the United States is:

1. A refuse retrieval device which includes: an elongated frame member having a handle section at one end, scoop supporting arms at the other end and an elongated central section therebetween; scoop means mounted to said supporting arms; and control rod means carried by said frame member and positioned to cooperate with said scoop means for opening and closing said scoop means;

wherein the improvement comprises:

(a) said retrieval device being constructed for one-handed operation and;

(b) said frame member being a unitary, elongated, molded-plastic member, which is substantially planar and flexible, and (i) said central section is constructed of a pair of elongated parallel beam members and a plurality of apertured transverse rigidifying braces connecting said beam members, said beam members defining an open slot therebetween; (ii) said handle section being integral with the central section and having an open box-like shape and capable of being flexed with respect to said central section; and (iii) said scoop supporting arms extending from said central section and being integral therewith;

(c) said scoop means having two half sections which define a clam shell-like shape with closed sidewalls, and said sidewalls being pivotally connected to said scoop supporting arms;

(d) said control rod means including an elongated rod having an actuating handle integral with one end thereof, said control rod extending through said slot in said central section and said apertured braces to a position adjacent said scoop means and said actuating handle being positioned within the plane of said frame handle section;

(e) link means for connecting the end of the control rod to each of said scoop sections;

(f) spring-biasing means positioned within said central section and said control rod extending therethrough for cooperation therewith in biasing said scoop sections to a normally closed position;

(g) collar means secured to said control rod adjacent the lower end of said spring-biasing means for cooperation with said rod and said spring-biasing means;

(h) said frame member, spring-biasing means, control rod, and link means constructed so as to permit one-handed operation by maintaining the scoop means in a normally-closed position when said control rod is not retracted and to permit said scoop means to be controllably opened and closed as said control rod is controllably retracted and released; and wherein (i) said frame handle section is adapted to be pivoted from the plane of said frame member so as to permit insertion of said control rod into said central section during fabrication.

* * * * *